US005477301A

United States Patent [19]

Earle et al.

[11] Patent Number: 5,477,301

[45] Date of Patent: Dec. 19, 1995

[54] PHOTOGRAPHIC PROCESSING APPARATUS

[75] Inventors: Anthony Earle, Harrow Weald; Michael Ridgway, Tring, both of United Kingdom

[73] Assignee: Eastman Kodak Company, Rochester, N.Y.

[21] Appl. No.: 239,179

[22] Filed: May 6, 1994

[51] Int. Cl.[6] ..... G03D 3/02

[52] U.S. Cl. ..... 354/325; 354/331

[58] Field of Search ..... 354/317–325, 354/331, 336; 134/64 P, 64 R, 122 P, 122 R; 430/398–400

[56] References Cited

U.S. PATENT DOCUMENTS

| | | | |
|---|---|---|---|
| 2,446,668 | 8/1948 | Tuttle et al. | 354/88 X |
| 2,961,938 | 11/1960 | Townley et al. | 251/141 |
| 3,331,276 | 7/1967 | Oliver | 355/309 |
| 3,674,490 | 7/1972 | Matejec | 430/376 |
| 4,300,828 | 11/1981 | Kaufmann | 354/322 |
| 4,688,918 | 8/1987 | Suzuki et al. | 354/325 |
| 4,783,675 | 11/1988 | Saito | 354/317 X |
| 5,121,131 | 6/1992 | Bouldin et al. | 346/75 X |

FOREIGN PATENT DOCUMENTS

| | | |
|---|---|---|
| 1362649 | 4/1963 | France . |
| 61-45242 | 5/1986 | Japan . |
| 1040861 | 9/1966 | United Kingdom . |
| 1399481 | 7/1975 | United Kingdom . |
| 1403418 | 8/1975 | United Kingdom . |
| 1560572 | 2/1980 | United Kingdom . |
| WO91/12567 | 2/1991 | WIPO . |
| WO91/03767 | 3/1991 | WIPO . |

*Primary Examiner*—D. Rutledge
*Attorney, Agent, or Firm*—Frank Pincelli

[57] ABSTRACT

Described herein is a compact photographic processor which uses small volumes of processing solution to achieve effective processing without the need for process control. The processor comprises an applicator element (50) having a plurality of orifices formed along its length, a plurality of reservoirs (54, 56, 58) each containing processing solution, and a pressure system (60, 61, 62). The element (50) is connected to one side of the reservoirs (54, 56, 58) by means of a manifold (52), the other side of the reservoirs (54, 56, 58) being connected to the pressure system (60, 61, 62). The processing solutions may be dispensed from the element (50) as jets.

3 Claims, 3 Drawing Sheets

PHOTOGRAPHIC PROCESSING APPARATUS

FIELD OF THE INVENTION

The present invention relates to photographic processing apparatus and is more particularly, although not exclusively, concerned with the processing of photographic materials using redox amplification chemistry.

BACKGROUND OF THE INVENTION

Redox amplification processes have been described, for example in GB-A-1 268 126, GB-A-1 399 481, GB-A-1 403 418 and GB-A-1 560 572. In such processes color materials are developed to produce a silver image (which may contain only small amounts of silver) and then treated with a redox amplifying solution (or a combined developer-amplifier) to form a dye image.

The developer-amplifier solution contains a reducing agent, for example, a color developing agent, and an oxidizing agent which will oxidize the color developing agent in the presence of the silver image which acts as a catalyst. The photographic material used in such a process may be a conventional coupler-containing silver halide material or an image transfer material containing redox dye releasers.

Oxidized color developer reacts with a color coupler (usually contained in the photographic material) to form image dye. The amount of dye formed depends on the time of treatment or the availability of color coupler rather than the amount of silver in the image as is the case in conventional color development processes.

Examples of suitable oxidizing agents include peroxy compounds including hydrogen peroxide and compounds which provide hydrogen peroxide, e.g. addition compounds of hydrogen peroxide; cobalt (III) complexes including cobalt hexammine complexes; and periodares. Mixtures of such compounds can also be used.

A particular application of this technology is in the processing of silver chloride color paper, especially such paper with low silver levels.

However, as the chemistry used in redox amplification processes are inherently unstable, it is uneconomic to use large volumes of processing solutions.

WO-A-91/12567 discloses a method for processing photographic material using a redox amplification process using the minimum of processing solution whilst providing fully acceptable results. The photographic material is passed through a tank containing the unstable processing solution and the processing solution is circulated through the tank at a rate in the range of 0.1 to 10 tank volumes per minute, in particular between 2 and 4 tank volumes per minute.

Ink-jet printers are generally well known. Printers of this type have print heads having very small nozzles and passageways through which the ink is transported from a reservoir for application on to a substrate, for example, a sheet of paper, as a series of dots making up an image. A resolution of 400 dots per inch is not uncommon. The print head or the substrate to be printed is moved relative to one another to provide the desired application of ink to form the image.

US-A-5 121 131 describes a system and method of using a modified ink-jet printer to create transmissive images in a developed photographic film. The method described comprises selectively oxidizing portions of an opaque developed film with an oxidizing solution to form transmissive areas in the film. The oxidizing solution is highly concentrated and is applies to just those portions of the film in which a transmissive image is desired. In the regions where the oxidizing solution is applied, the silver grains are oxidized to form silver ions which are poor light absorbers. A computer-controlled ink-jet printer is used to direct very fine droplets of the oxidizing solution on to the film in the selected portions. A positive or negative image can be formed in this way. The resultant film requires no further processing and its surface is left substantially dry.

PROBLEM TO BE SOLVED BY THE INVENTION

Although US-A-5 121 131 describes the use of a modified ink-jet printer to process selected areas of a developed film, it does not allow for the complete processing of a sheet of photographic material, that is, developing, bleaching fixing and washing of the material.

Furthermore, most known photographic processors are relatively large and are not suitable for desktop applications.

SUMMARY OF THE INVENTION

It is therefore an object of the present invention to provide a photographic processor which overcomes the problems mentioned above.

In accordance with one aspect of the present invention, there is provided photographic processing apparatus for processing photographic material comprising:

support means for supporting the material to be processed;

at least one reservoir containing processing solution;

applicator means connected to each reservoir and operable for applying processing solution to the material; and control means for controlling the applicator means to provide an appropriate amount of processing solution to effect processing of the material;

characterized in that the applicator means comprises at least one applicator element having at least one orifice formed therein through which processing solution is directed for application to the material, and valve means for controlling the flow of processing solution through the orifices in each applicator element.

ADVANTAGEOUS EFFECT OF THE INVENTION

By this arrangement, only low volumes of processing solution are required.

Furthermore, the reservoirs may be sealed containers or cartridges from which the processing solutions are dispensed. This means that a user does not make contact with the processing solutions.

Mixing of the photographic processing solutions can be achieved on the surface of the photographic material. As a result, unstable processing chemistries can be utilized, for example, redox amplification processes. This produces even processing and repeatable results. For example, in developer/amplifier processes, the developer and peroxide solutions can be kept separate until they are applied on to the surface of the material being processed. Similarly, sodium thiosulphate and acid used in stop bleach/fix processes can be dispensed the same way.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
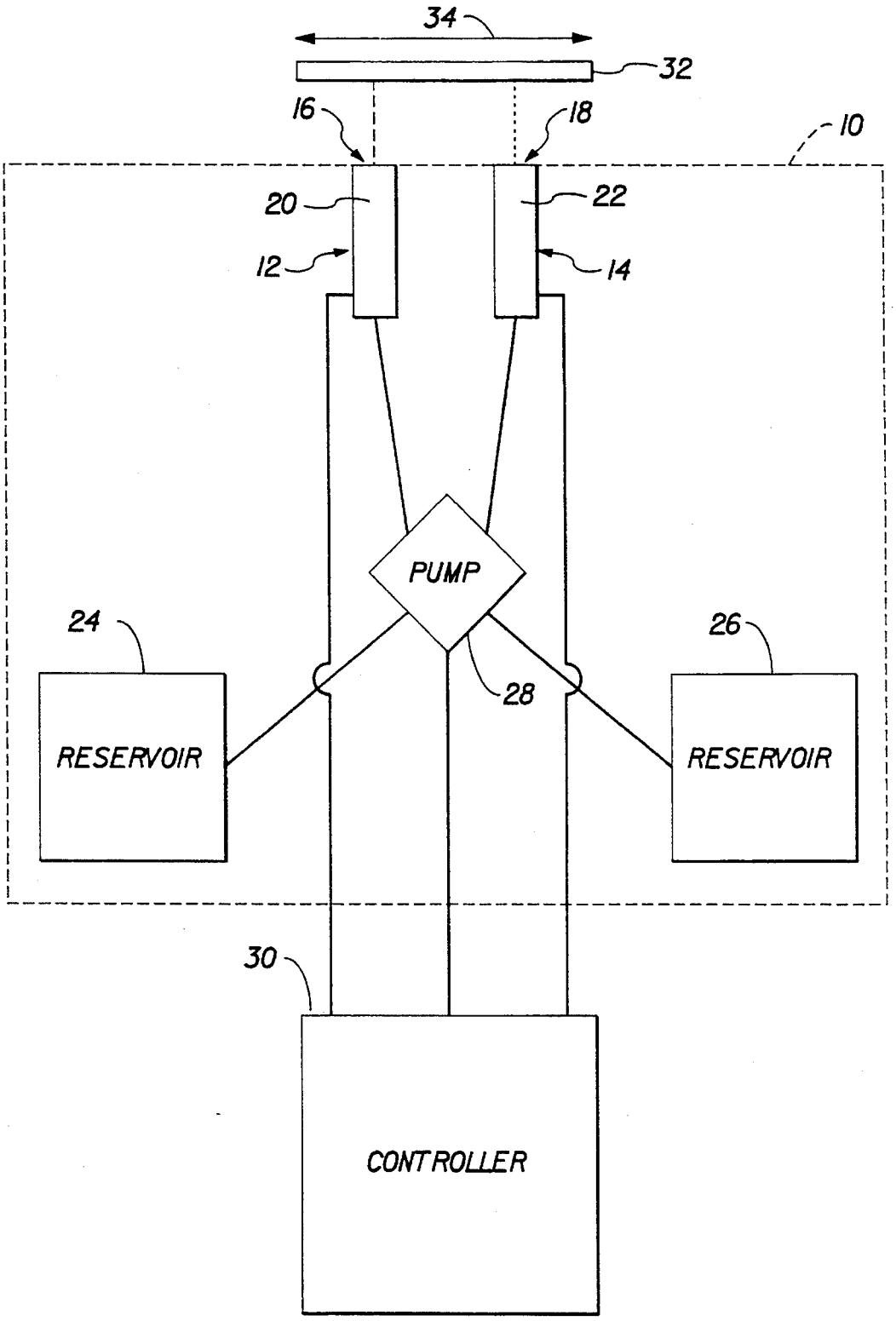
FIG. 1 is a schematic block diagram of one embodiment of apparatus constructed in accordance with the present invention.

FIG. 1 shows an ink-jet printer unit 10 which comprises two ink-jet heads 12, 14 each having an orifice 16, 18 and a pulsed solenoid control valve 20, 22. Each head 12, 14 is connected to a respective reservoir 24, 26 containing processing solution via a pump unit 28 which pumps solution from the reservoirs 24, 26 to the appropriate head 12, 14.

The ink-jet unit 10 is connected to a controller 30 by means of pump unit 28. The controller may conveniently be a computer or other microprocessor. Connection is also made between the controller 30 and the solenoid control valves 20, 22 in the heads 12, 14, as shown, so that they can be operated to dispense the solution as required.

As shown in FIG. 1, the ink-jet unit 10 is arranged to apply processing solution to photographic material 32. In order to achieve this, the ink-jet unit 10 is passed over the surface of the material 32 as shown by arrow 34. Naturally, it would also be possible to move the material 32 relative to the ink-jet unit 10.

The solenoid control valves 20, 22 associated which each head 12, 14 are high speed valves and operate to interrupt the flow of solution from the pump unit 28 to each orifice 16, 18. The interruption of flow of processing solution produces a series of spheres which impinge on the surface of the material 32 as the unit 10 passes over the surface of the material 32. Dispensing of solution from orifice 16 in head 12 is shown as a dashed line and from orifice 18 in head 14 as a dotted line.

Figure 2:
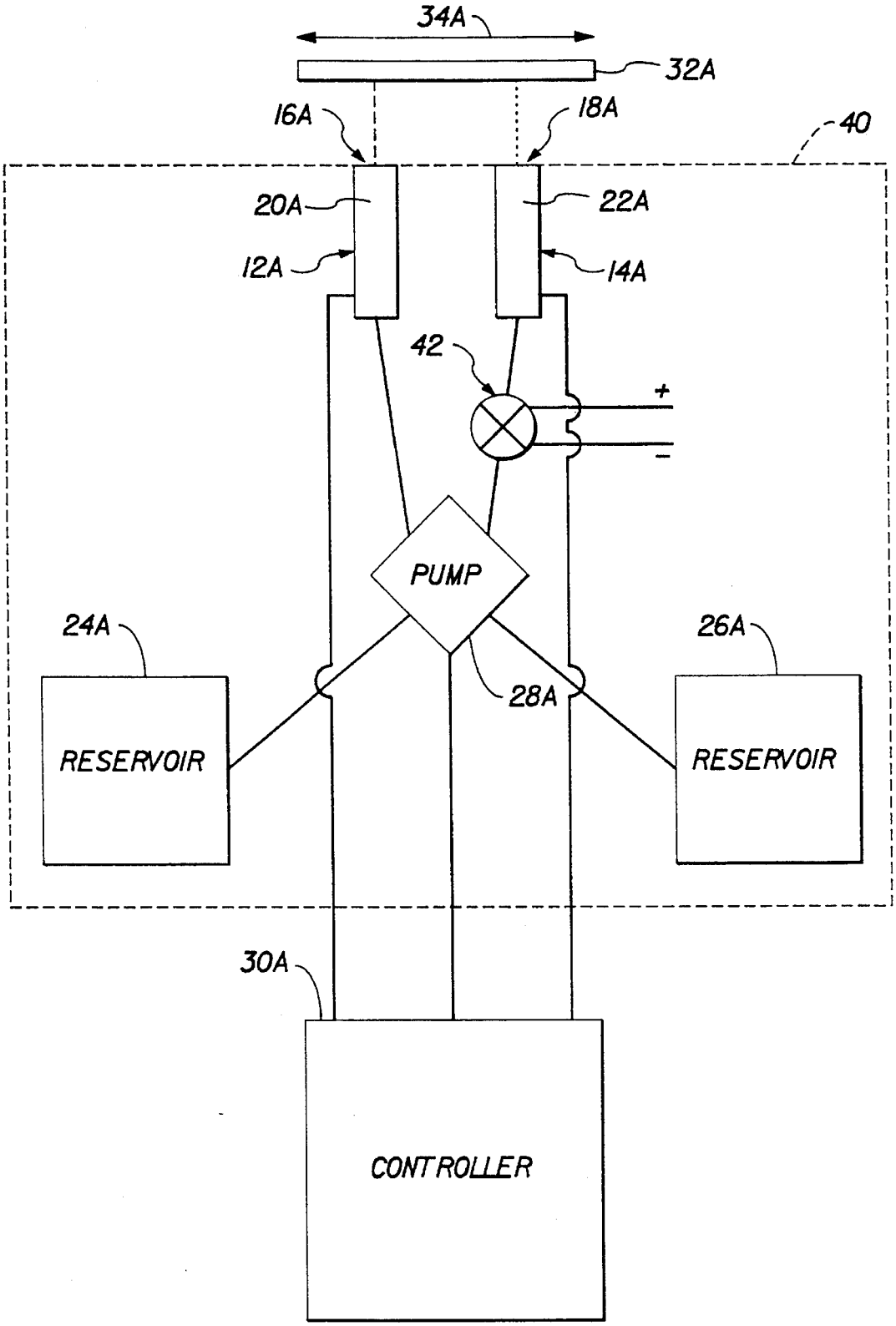
FIG. 2 is similar to FIG. 1 but illustrating apparatus for manufacturing and dispensing developer solution.

FIG. 2 shows an arrangement similar to that shown in FIG. 1. Parts already described will be referenced alike but with the suffix 'A'. In FIG. 2, the ink-jet unit 40 is identical to ink-jet unit 10 of FIG. 1 with the exception of the addition of an electrolytic cell 42. The electrolytic cell 42 is used to reduce a developer precursor, such as p-nitroso-dimethylaniline, stored in reservoir 26A into developer immediately before the developer is required for use. Production of developer in this way is described in detail in copending European patent application no. 94201049.7 entitled "Method of Making a Photographic Developer Solution" and filed Apr. 9, 1994.

Naturally, the electrolytic cell need not form part of the ink-jet unit as described above. The cell could be a separate component which converts the developer precursor to developer and then feeds the developer into a reservoir. This reservoir is then used to supply the developer to the ink-jet unit as required.

In the particular application of an ink-jet head as described with reference to FIGS. 1 and 2, an Alphadot ink-jet printer head was used. This was because the droplets produced by this head are larger than those normally associated with bubblejet or PZT or some Sweet heads.

Figure 3:
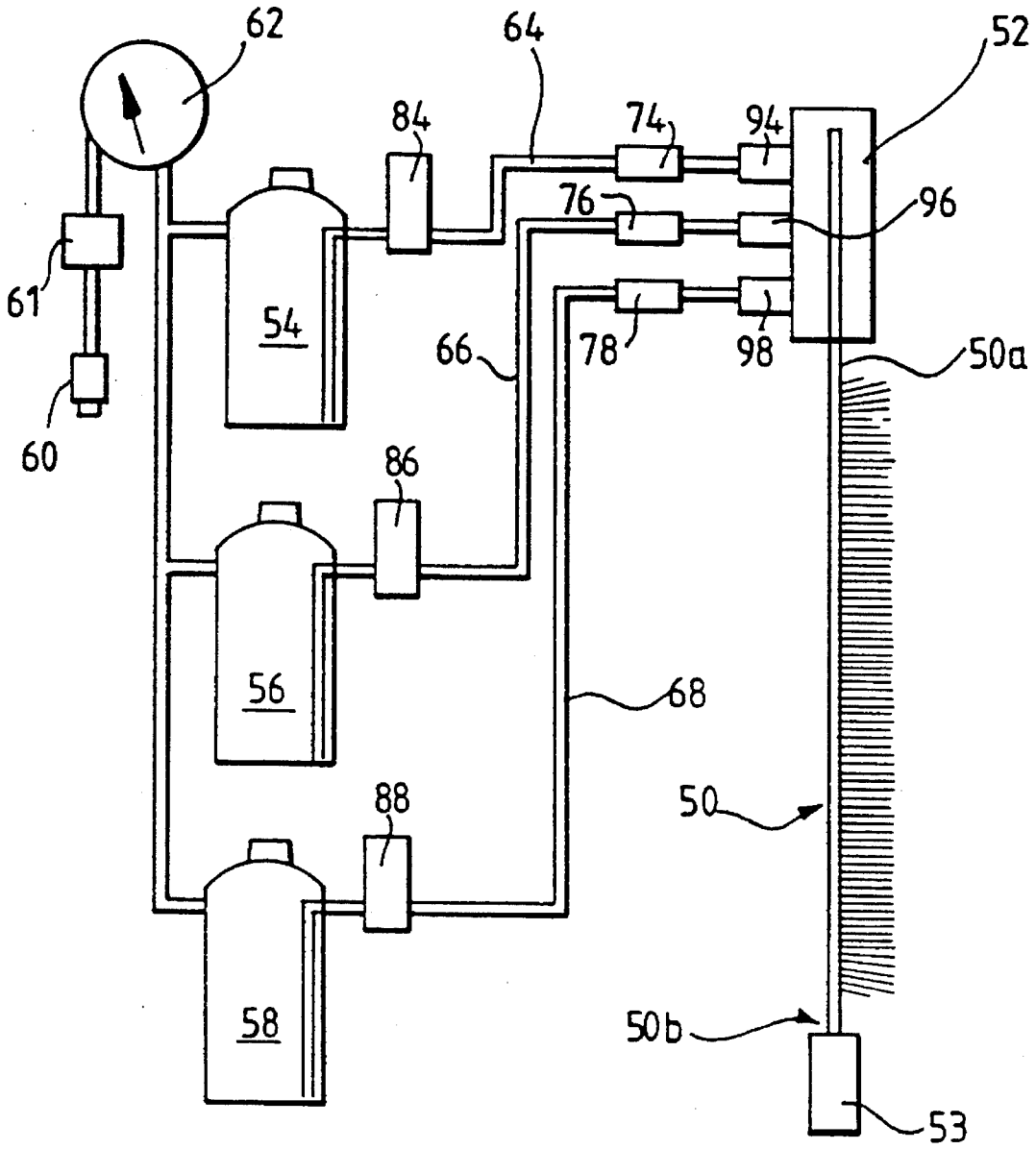
FIG. 3 is a schematic block diagram of a second embodiment of apparatus constructed in accordance with the present invention.

FIG. 3 illustrates a modification of the apparatus shown in FIGS. 1 and 2. Here, a continuous spray bar is utilized instead of an ink-jet head. The spray bar 50 is connected at one end 50*a* to a manifold 52 through which processing solution is directed by control means (not shown). The other end 50*b* of the spray bar 50 is connected to a valve 53 which enables solutions to be drained from the bar when it is not in use. Alternatively, valve 53 enables the spray bar to be flushed before the introduction of fresh processing solution.

The processing solutions are stored in bottle reservoirs 54, 56, 58 which are connected to the manifold 52 by means of respective conduits 64, 66, 68. Filters 74, 76, 78 are provided in respective ones of the conduits 64, 66, 68 to filter out material which may block the holes in the spray bar 50. Valves 84, 86, 88 and 94, 96, 98 are provided one each side of the filters 74, 76, 78. Preferably, valves 94, 96, 98 are non-return valves.

Each bottle reservoir 54, 56, 58 is connected to an air supply 60 via a tap 61 and a pressure gauge 62 as shown. Air from the air supply 60 is used to force solution out of the appropriate bottle reservoir 54, 56, 58, into the associated conduit 64, 66, 68, into the manifold 52 and out through the spray bar 50.

The spray bar 50 may comprise a tube having a plurality of simple holes formed therein through which processing solution is directed on to the material being processed. The spacing of the holes and the diameter of the tube is determined by the working pressure required to dispense the processing solutions. For example, for a working pressure of 6.9 kPa (10 psi) the spray bar 50 may comprise a tube having an internal diameter of 4 mm with holes of diameter 100 μm spaced along the tube at a pitch of 500 μm.

Due to the tube used to make spray bar 50 being small and taking up little room, more than one such tube can be fixed together to form a single applicator head.

It is to be noted that, although only two heads are shown in the ink-jet units 10, 10A described with reference to FIGS. 1 and 2, other similar heads can be provided—one for each processing solution required to process a particular photographic material.

Naturally, a single head could be used in ink-jet unit 10, 10A as described above. In this case, solutions would be flushed through the head between applications of the different processing solutions.

In the embodiments of the present invention described with reference to FIGS. 1 and 2, composite drops of solutions can be formed. For example, one processing solution can be forced through a stream of another solution to produce drops of liquid which comprise components of both processing solutions.

However, the present invention does not require all the processing solutions to be applied using either the ink-jet units 10, 10A or spray bar 50. Conventional fixing and washing stages may be utilized where appropriate.

A processing solution laydown of 161.5 ml/m$^2$ (15 ml/ft$^2$) is easily attainable using the apparatus of the present invention.

Ideally, the material to be processed is supported horizontally with the unit 10, 10A or bar 50 passing over the surface of the material. This enables effective use of the processing solution without the disadvantages of the solution draining off the surface or thickening in localized areas due to solution build up.

It is preferable that the material to be processed using apparatus according to the present invention is in sheet form. Each sheet is retained against a support using the surface tension of a liquid. For example, a layer of water (or other suitable liquid which does not interfere with the processing) is applied to the surface of the support, and the sheet is then placed on the support over the layer of water.

Surfactants may be used to assist the spreading of the processing solutions over the surface of the sheet of material being processed. Surfactants can be applied to the sheet in many ways. First, the surfactant may be provided in the standard developer solution and is applied to the surface of the material therewith. Secondly, the surfactant may be present in the emulsion coating of the material being processed. Thirdly, the surfactant can be applied as a pretreatment prior to the application of the developer solution.

Conveniently, developer and other processing solutions can be supplied in cartridges which are sealed to protect the user from contact with the solutions. In particular, contact with developer is eliminated thereby reducing the risk of dermatitis. Furthermore, this also protects the solutions from oxidation due to contact with the air.

As described with reference to FIG. 3, processing solutions are supplied in bottle reservoirs. Naturally, these bottle reservoirs could be replaced by cartridges.

Surplus developer solution left on the surface of the material being processed can be deactivated in the bleach stage. This reduces the risk of developer being discharged as effluent.

Different laydowns and processing times can easily be achieved with the apparatus according to the present invention using simple software control.

The apparatus according to the present invention is especially useful in situations where the apparatus would be used relatively infrequently. The processing solutions would be stored in separate, sealed boxes and would only mix when applied to the surface of the material being processed.

Advantageously, the apparatus according to the present invention can also be used with activator type processes, for example, in a process where a high pH solution is dispensed on to a developer incorporated product.

The apparatus of the present invention could also be used for the application of photographic monobath solutions.

As will readily be appreciated, the apparatus of the present invention is intrinsically small and compact and has very few moving parts.

We claim:

1. Photographic processing apparatus for processing photographic material comprising:

support means for supporting the material to be processed;

at least one reservoir containing processing solution;

applicator means connected to each reservoir and operable for applying processing solution to the material; and control means for controlling the applicator means to provide an appropriate amount of processing solution to effect processing of the material;

characterized in that the applicator means comprises at least one applicator element having at least one orifice formed therein through which processing solution is directed for application to the material, and valve means for controlling the flow of processing solution through the orifices in each applicator element, wherein at least one reservoir contains developer solution made from a developer precursor.

2. Apparatus according to claim 1, wherein the applicator element comprises an ink-jet head.

3. Apparatus according to claim 1, wherein the applicator element comprises a spray bar.

* * * * *